United States Patent [19]

Fisher

[11] Patent Number: 4,969,558

[45] Date of Patent: Nov. 13, 1990

[54] LUNCHBOX APPARATUS FOR MICROWAVE

[76] Inventor: Timothy M. Fisher, P.O. Box 5, Okeene, Okla. 73763

[21] Appl. No.: 427,527

[22] Filed: Oct. 27, 1989

[51] Int. Cl.[5] ..... B65D 51/24

[52] U.S. Cl. ..... 206/549; 99/DIG. 14; 206/541; 219/10.55 E; 220/91; 220/23; 220/212; 426/107; 426/243

[58] Field of Search ..... 206/541–549; 99/DIG. 14; 219/10.55 E; 220/91, 94 R, 23, 212, 318; 426/107, 109, 113, 234, 243

[56] References Cited

U.S. PATENT DOCUMENTS

| | | | |
|---|---|---|---|
| 2,622,187 | 12/1952 | Welch | 426/234 |
| 3,078,005 | 2/1963 | Lewerth | 220/212 |
| 3,107,027 | 10/1963 | Hong | 206/546 |
| 3,565,277 | 2/1971 | Sewitch | 206/549 |
| 4,081,646 | 3/1978 | Goltsos | 426/107 |
| 4,530,344 | 7/1985 | Iyengar et al. | 206/545 |
| 4,648,512 | 3/1987 | Tarozzi et al. | 206/545 |
| 4,663,506 | 5/1987 | Bowen et al. | 426/243 |
| 4,871,892 | 10/1989 | Samford | 426/243 |
| 4,880,951 | 11/1989 | Levinson | 426/243 |

*Primary Examiner*—Jimmy G. Foster
*Attorney, Agent, or Firm*—Leon Gilden

[57] ABSTRACT

A lunchbox apparatus is arranged for use with a microwave wherein a removable lid frictionally engaging an upper end of the lunchbox container is of a first material, such as a polymeric plate, for use with a microwave while the lunchbox container portion is of a second metallic material. The lid may include compartments therewithin for securement of different food components and additionally may include spaced walls defining a single chamber therebetween containing a liquid arranged for accepting heat during microwave use and imparting such heat to foods contained within the various compartments of the lunchbox lid. A support stand for pivotally mounting the lunchbox interiorly of a microwave or upon a surface during use is optionally provided.

2 Claims, 4 Drawing Sheets

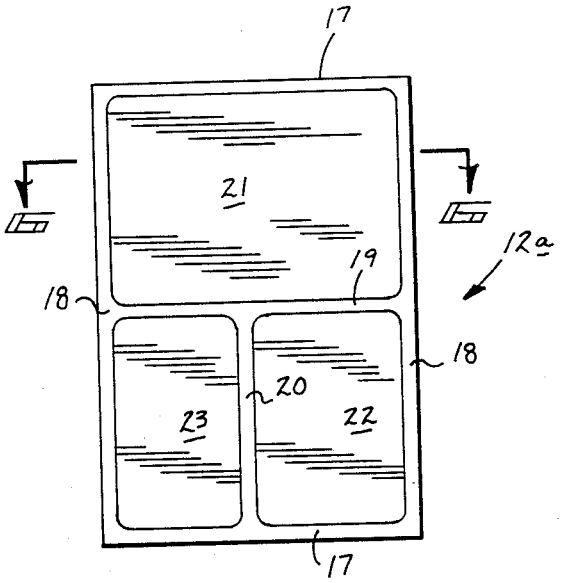
FIG 5
FIG 6
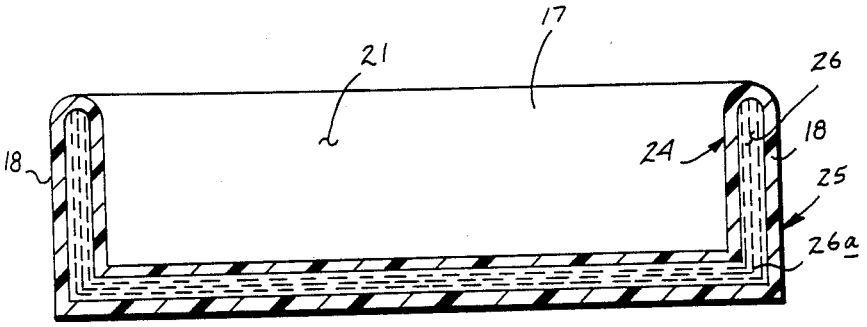

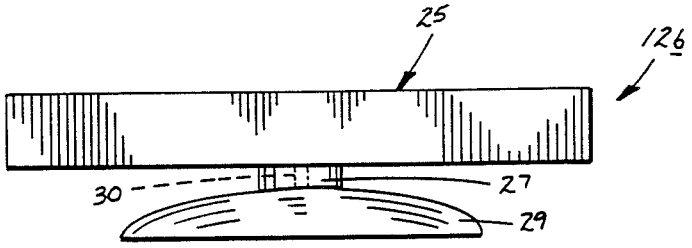
Fig 7
Fig 8
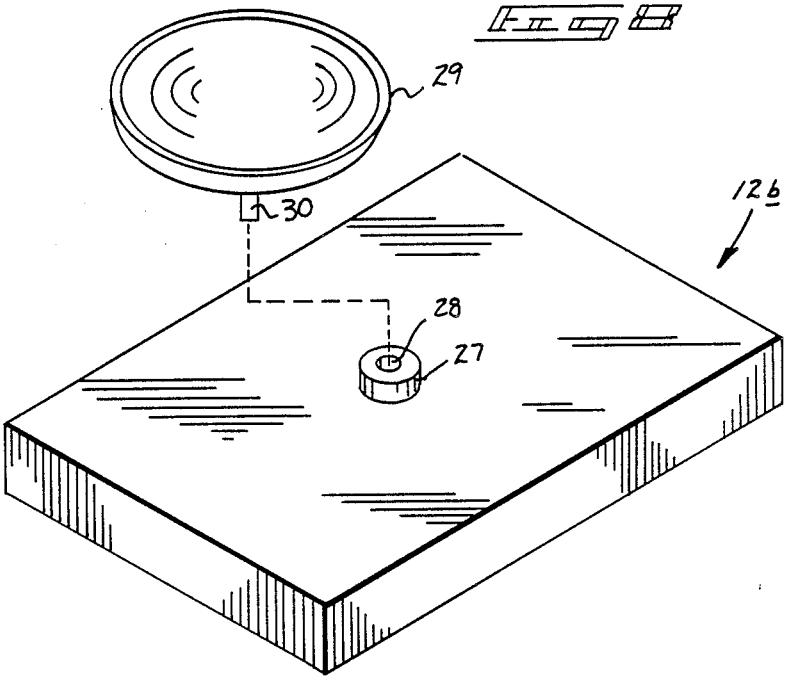

LUNCHBOX APPARATUS FOR MICROWAVE

BACKGROUND OF THE INVENTION

1. Field of the Invention

The field of invention relates to lunchbox constructions, and more particularly pertains to a new and improved lunchbox for particular use with microwaves.

2. Description of the Prior Art

The prior art has provided lunchbox arrangements for supporting various components therewithin, such as a thermos, various food compartments and the like within the container of the lunchbox, while additionally, types of lunchboxes such as insulated lunchboxes and the like have been utilized to minimize thermal loss through the walls of the lunchbox during storage of the food therewithin. Contemporarily, however, the availability of microwave ovens has enabled individuals to reheat foods transported within a lunchbox where a completely removable lid or component has been unavailable to enable use within a microwave oven. The instant invention attempts to overcome the disadvantages of the prior art by providing a non-metallic lid for use within microwaves for reheating foods.

Examples of the prior art include U.S. Pat. No. 3,372,690 to Ruiz to illustrate the use of an insulated lunchbox arrangement that contains a tray where it is noted, however, that the lunchbox does not provide for a convenient support member for microwave use.

U.S. Pat. No. 51,957 to Minor illustrates the use of a lunchbox assemblage provided with various components for storage of utensils and the like.

U.S. Pat. No. 2,731,996 to Hayes illustrates the use of a removable tray for use within the lunchbox. U.S. Pat. No. 2,645,332 to Martin illustrates a compartmentalized lunchbox with a removable tray positioned therewithin.

U.S. Pat. No. 4,360,105 to Williams illustrates a lunchbox container with a compartmentalized lid for use therewith.

As such, it may be appreciated that there is a continuing need for a new and improved lunchbox apparatus for microwave use which addresses both the problems of compactness in construction and ease of use with microwaves and in this respect, the present invention substantially fulfills this need.

SUMMARY OF THE INVENTION

In view of the foregoing disadvantages inherent in the known types of lunchbox apparatus now present in the prior art, the present invention provides a lunchbox apparatus for microwave use wherein the same utilizes a lid component removable from the lunchbox container for use particularly with microwaves. As such, the general purpose of the present invention, which will be described subsequently in greater detail, is to provide a new and improved lunchbox apparatus for microwave use which has all the advantages of the prior art lunchbox apparatus and none of the disadvantages.

To attain this, the present invention includes a container with a lid mounted thereon completely removable from the container upon pivotment of a support handle ninety degrees relative to the container. The lid includes various compartments therewithin for receiving various food components and is provided with an exterior continuous wall and an interior continuous wall defining a single chamber therebetween containing a fluid to retain and direct heat into the various compartments of the lid for continuous heating of food components therewithin. A swivel base is optionally mounted to an exterior surface of the lid for microwave use containing a cylindrical boss with a coaxial bore for receiving a stem of a support stand for positioning within a microwave minimizing rotation of the lid during use within a microwave, as well as providing for a swivel base for use by an individual during consumption of food from within the lid.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable to U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lunchbox apparatus for microwave use which has all the advantages of the prior art lunchbox apparatus and none of the disadvantages.

It is another object of the present invention to provide a new and improved lunchbox apparatus for microwave use which may be easily and efficiently manufactured and marketed.

It is a further object of the present invention to provide a new and improved lunchbox apparatus for microwave use which is of a durable and reliable construction.

An even further object of the present invention is to provide a new and improved lunchbox apparatus for microwave use which is susceptible of a low cost of manufacture with regard to both materials and labor, and which accordingly is then susceptible of low prices of sale to the consuming public, thereby making such lunchbox apparatus for microwave use economically available to the buying public.

Still yet another object of the present invention is to provide a new and improved lunchbox apparatus for microwave use which provides in the apparatuses and methods of the prior art some of the advantages thereof, while simultaneously overcoming some of the disadvantages normally associated therewith.

Still another object of the present invention is to provide a new and improved lunchbox apparatus for microwave use wherein a lid is removably securable to a lunchbox container component for positioning within a microwave for subsequent reheating of food components stored within the lunch box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a top orthographic view of a further embodiment of the lunchbox lid.

FIG. 6 is an orthographic view taken along the lines 6—6 of FIG. 5 in the direction indicated by the arrows.

FIG. 7 is an orthographic side view taken in elevation of a yet further modification of the lunchbox lid.

FIG. 8 is an isometric illustration of the yet further lunchbox lid of the instant invention.

DESCRIPTION OF THE PREFERRED EMBODIMENT

Figure 1:
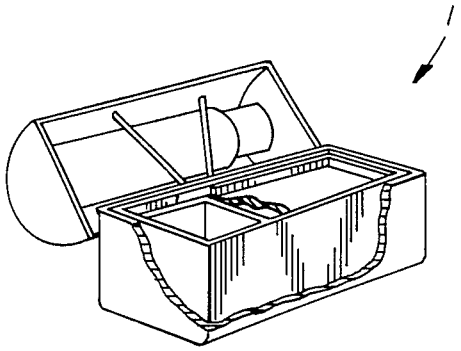
FIG. 1 is an isometric illustration of a typical prior art lunchbox apparatus.

With reference now to the drawings, and in particular to FIGS. 1 to 8 thereof, a new and improved lunchbox apparatus for microwave use embodying the principles and concepts of the present invention and generally designated by the reference numeral 10 will be described.

More specifically, the lunchbox apparatus 10 of the instant invention essentially comprises an improvement over the prior art lunchbox apparatus 1 containing various components and chambers within a lunchbox for the storage of various lunch components such as food, a thermos, and the like.

Figure 2:
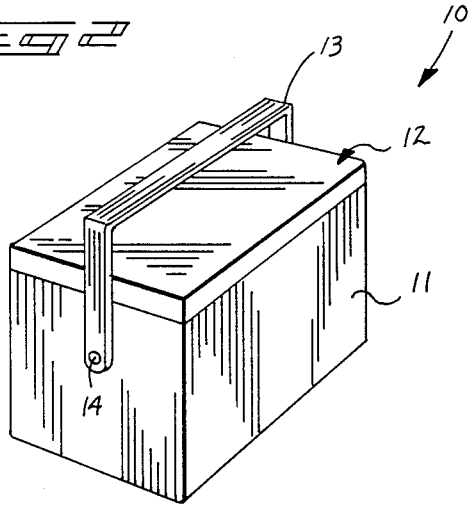
PRIOR ART FIG 2
FIG. 2 is an isometric illustration of the instant invention.
Figure 3:
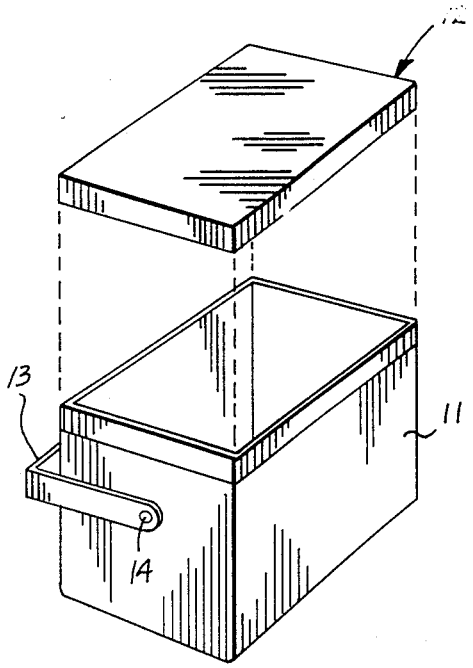
FIG. 3 illustrates the lid of the instant invention removed from the lunchbox container upon pivotment of the associated lid.
Figure 4:
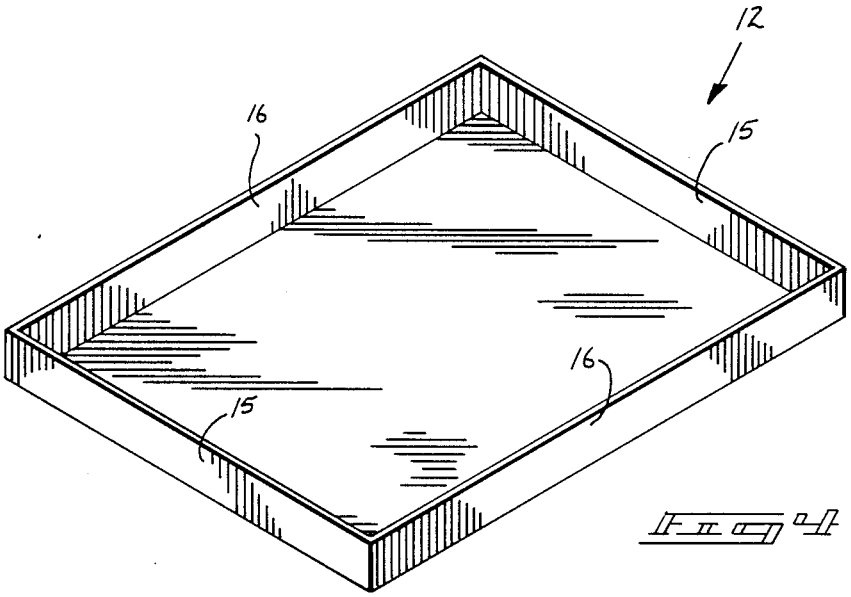
FIG. 4 is a bottom isometric illustration of a first embodiment of the lunchbox lid.

FIG. 2 illustrates the lunchbox apparatus 10 of the instant invention including a lid member 12 reciprocatably removable from association with an upper end of the container assembly 11 wherein a "U" shaped handle 13 includes a plurality of pivot axles 14 directed orthogonally through side walls of the container assembly 11 and upon a ninety degree pivotment of the handle 13, the lid member 12 is reciprocatably removable from frictional engagement with the container assembly 11, as illustrated in FIG. 3 for example. The lid assembly 12 is in its first form illustrated for use with end walls 15 and side walls 16 orthogonally mounted to the top wall of the lid for receiving food components therewithin for positioning within a microwave for subsequent reheating of the food portions. The lid member 12 is formed of a polymeric material in association with the metallic container assembly 11 to incorporate the durable aspects of a metallic container and the provision of a polymeric lid enabling microwave use.

FIG. 5 is illustrative of a further embodiment of the lid **12*a* for use with the container assembly 11 wherein end walls 17 and side walls 18 contain partition walls. More specifically, a medial first partition wall 19 is directed orthogonally between the side walls 18 with a second partition wall 20 orthogonally directed between the first partition wall 19 and an interior surface of an end wall 17. A first compartment 21, a second compartment 22, and a third compartment 23** are thereby provided for receiving discrete food portions therewithin for subsequent consumption and maintaining the characteristic integrity of each food during a reheating procedure within a microwave.

FIG. 6 illustrates the construction of the modified lid **12*a* wherein a continuous outer wall 25 cooperates with a continuous inner wall 24 in a spaced relationship to define an enclosed continuous chamber 26 therebetween containing a liquid medium 26*a*. The liquid medium 26*a* is adapted for receiving microwave energy to heat the liquid medium and thereafter impart the thusly acquired heating of the liquid onto the greatest food components formed within the various compartments 21, 22, and 23 within the modified lid 12*a***.

FIGS. 7 and 8 illustrate a yet further modified lid member **12*b* wherein the exterior elongate top surface of the outer wall 25 contains a projecting cylindrical boss 27 orthogonally relative thereto and medially positioned relative to the top wall surface. The boss 27 contains an axially aligned central smooth bore 28 for receiving a cylindrical stem 30 of a mount 29. The mount 29 is positionable, as illustrated in the arrangement of FIG. 7, for positioning within a microwave-type oven to minimize rotation of the tray as desired by an individual, wherein thereafter the mount may be utilized to enable pivotment of the tray for access of the individual to various portions of the interior compartments 21, 22, and 23, per the illustration of FIG. 5. The cylindrical stem 30 is defined by a predetermined length greater than that of the depth of the bore 28 to enable the stand 29 to project exteriorly of the boss 27, and wherein the stem 30 is defined by an external diameter substantially equal to or somewhat less than that defined by the bore 28** to enable ease of rotation of the stem within the associated bore.

As to the manner to usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lunchbox apparatus comprising a container formed of a first material and a lid formed of a second material, wherein the second material is adapted for use within a microwave-type oven, the container including a "U" shaped handle means pivotally mounted to spaced end walls of the container for access of the lid, the lid frictionally engaging the upper end of the container and mounted for complete disassociation from the container during use, and wherein the lid is formed of a polymeric material and the container formed of a metallic material, and wherein the lid includes spaced side walls, and spaced end walls, and further includes a first partition orthogonally directed between the spaced side walls, and a second partition orthogonally directed between the first partition and an interior surface of an end wall, and wherein the lid includes a continuous top surface spaced from a continuous interior bottom surface defining an enclosed chamber therebetween, and wherein the enclosed chamber includes a liquid medium for heating of said medium during microwave use and thereafter imparting and transferring heat into a plurality of compartments defined by the first and second partitions interiorly of the lid.

2. A lunchbox apparatus as set forth in claim 1 wherein the lid includes a planar, continuous top wall defined by the exterior wall, and further includes a cylindrical boss directed orthogonally and outwardly of the exterior surface of the top wall, and wherein the boss includes a cylindrical bore of a predetermined depth therewithin, and wherein the lid further includes a stand member, the stand member includes a cylindrical stem defined by a predetermined length greater than the predetermined depth of the bore and defined by a predetermined external diameter less than the internal diameter of the bore to enable rotation of the boss about the stem when positioned thereon.

* * * * *